United States Patent [19]

Richter

[11] 4,277,927

[45] Jul. 14, 1981

[54] SPACER FOR THE BRICKS OF A FACING BRICKWORK TO BE PLACED IN FRONT OF AN INNER BRICKWORK

[76] Inventor: Stefan Richter, Eilswiese 8, 2000 Hamburg 65, Fed. Rep. of Germany

[21] Appl. No.: 91,952

[22] Filed: Nov. 7, 1979

[30] Foreign Application Priority Data

May 30, 1979 [DE] Fed. Rep. of Germany ... 7915579[U]
Jun. 15, 1979 [DE] Fed. Rep. of Germany ... 7917143[U]

[51] Int. Cl.[3] ..... E04G 21/16; G01B 3/30

[52] U.S. Cl. ..... 52/749; 33/174 G; 33/180 R; 52/424; 52/442; 52/509; 52/604; 52/747

[58] Field of Search ..... 33/174 G, 180 R; 52/127, 509, 424, 426, 562, 603, 604, 747, 749, 442

[56] References Cited

U.S. PATENT DOCUMENTS

| | | | |
|---|---|---|---|
| 2,292,085 | 8/1942 | Powell | 52/603 X |
| 2,466,919 | 4/1949 | Sykes | 52/749 X |
| 2,797,495 | 7/1957 | Walston | 33/180 R |
| 2,991,857 | 7/1961 | Soderberg | 33/180 R X |
| 3,485,003 | 12/1969 | McDowell | 52/562 X |
| 3,501,877 | 3/1970 | White | 52/604 X |
| 4,114,337 | 9/1978 | Neuhardt | 52/442 |

FOREIGN PATENT DOCUMENTS

| | | | |
|---|---|---|---|
| 487907 | 8/1918 | France | 52/127 |

*Primary Examiner*—Alfred C. Perham

[57] ABSTRACT

A spacer for bricks of a facing brickwork placed in front of an inner brickwork, whereby the spacer can be universally used and at the end of the bricklaying work can be removed from the mortar joints of the front of the wall, so that it does not constitute a disposable part and can be reused. Such a spacer includes a unitary body having two contact surfaces in a common plane and below the contact surfaces nominal width stops in two parallel planes perpendicular to the contact surfaces and nominal depth stops are located in two further parallel planes perpendicular both to the plane of the contact surfaces and to the planes of the nominal width stops for adjacent bricks, with the distance between the planes corresponding to the nominal depth of the distance between the facing brickwork and the inner brickwork. The nominal depth stops extending between two adjacent bricks of the facing brickwork on the one hand and the inner brickwork to be faced on the other.

10 Claims, 5 Drawing Figures

Figure 1:
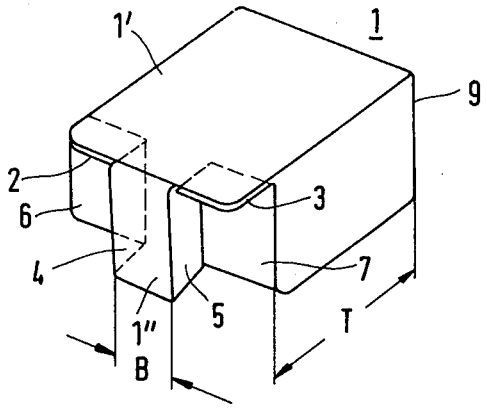

SPACER FOR THE BRICKS OF A FACING BRICKWORK TO BE PLACED IN FRONT OF AN INNER BRICKWORK

The invention relates to a spacer for the bricks of a facing brickwork to be placed in front of an inner brickwork.

The problem of the invention is to provide a simple and inexpensive spacer which, through being inserted as a disposable supplementary part between in each case two adjacent bricks of the facing brickwork and also between the latter and the already erected inner brickwork facilitates the correct and accurate alignment of the bricks when erecting the facing brickwork. Such a spacer must at the same time be as simple as possible, but also sufficiently stable, so that the additional expenditure resulting from its use as a disposable additional part in very large numbers is kept low.

According to the invention, this problem is solved by a spacer of the type defined hereinbefore which comprises a body in one piece having two contact surfaces in a common plane and below said contact surfaces nominal width stops in two parallel planes perpendicular thereto and in two further parallel planes perpendicular both to the plane of the contact surfaces and to the planes of the nominal width stops for adjacent bricks, the distance between said planes corresponding to the nominal depth of the distance between the facing brickwork and the inner brickwork, nominal depth stops for in each case two adjacent bricks of the facing brickwork on the one hand and the inner brickwork to be faced on the other.

The invention also relates to a spacer which has a covering plate extending to opposite sides from a vertical central wall and whose one part which at its front end passes into the vertical wall giving the nominal width forms on its other side the horizontal contact surfaces passing in a common plane and on its lateral edges carries vertically upwardly projecting walls whose height is that of the nominal height and whose other part, whose length corresponds to the nominal depth forms with its top a further contact surface and has on its lateral edges vertically downwardly projecting walls whose height corresponds to the nominal height. Thus, a spacer is obtained which can be used much more universally, and in particular when erecting a facing wall can also be used on the front thereof and then when the bricklaying work is at an end can be drawn out of the mortar joints of the wall front again, so that in such a case it does not constitute a disposable part and, if desired, can be used again. This spacer is simple, but sufficiently stable and as a plastic shaped article can be economically manufactured in very large numbers. In addition, such a spacer can be used when building the facing brickwork on the back thereof for maintaining the spacing relative to the inner brickwork and for maintaining all the joint spacings between a particular brick and the adjacent bricks, it being left in the brickwork as a disposable component. It can also be used on the front of the facing brickwork for maintaining the joint spacings of each brick relative to adjacent bricks and the possibility then exists to draw it in the forwards direction out of the still soft mortar on completing the brickwork.

According to another proposal of the invention, in order to facilitate its removal, that part of the covering wall, whose length corresponds to the nominal depth, is provided with an opening in the form of an eyelet in order to possibly facilitate the removal from the front of a bricked wall.

Further advantageous developments of the invention can be gathered from the subclaims.

The invention is described in greater detail hereinafter relative to the drawings, wherein show:

FIG. 1 a spacer in a solid construction.

Figure 2:
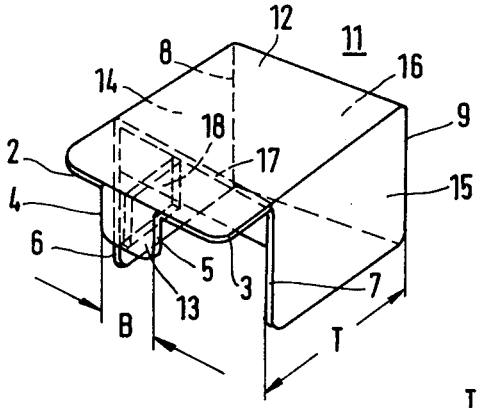

FIG. 2 a spacer constructed in the form of a box-like hollow body.

Figure 3:
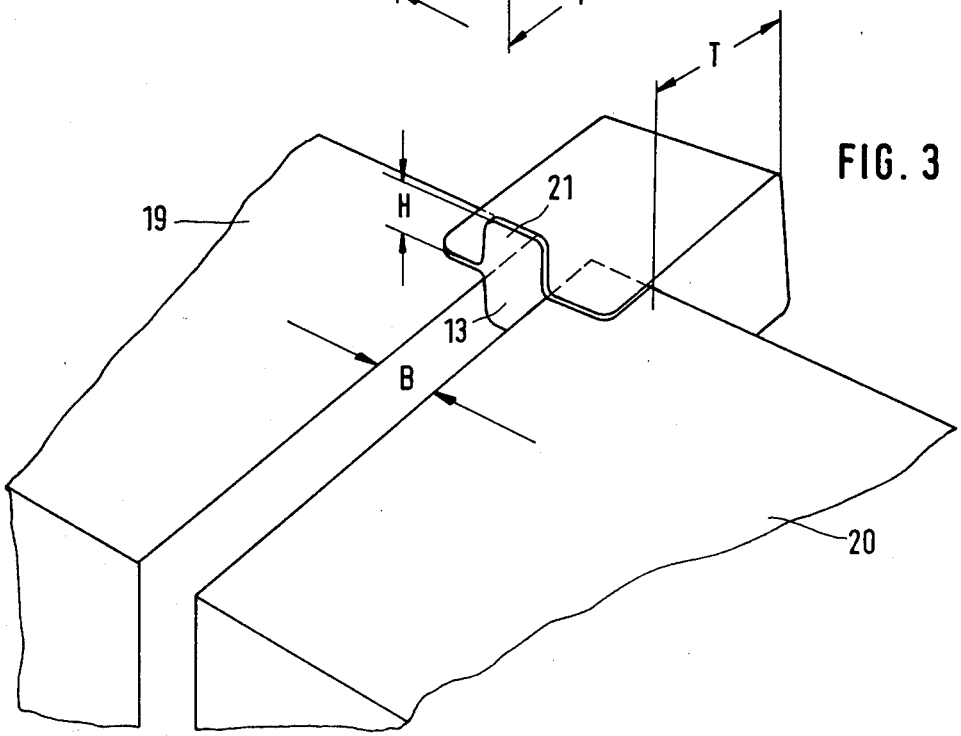

FIG. 3 the use of a spacer between two adjacent bricks of a facing wall.

Figure 4:
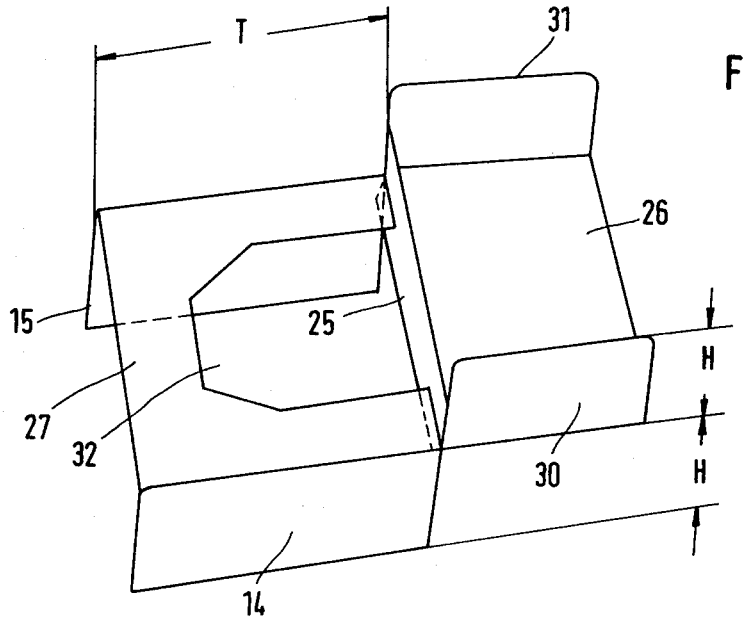
Figure 5:
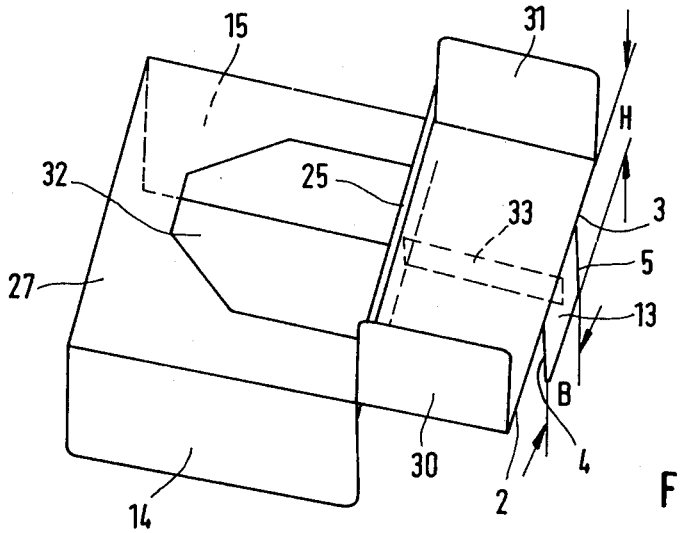

FIGS. 4 and 5 a further embodiment of a spacer in two different positions on a substrate surface.

In the embodiment of the spacer according to FIG. 1, the one-piece body 1 is shaped like a block, comprising a parallelepipedic part 1', a smaller parallelepipedic part 1'' placed on the front surface thereof and two covering walls flush with the top of said first two parts and which cover the angular spaces between the two parallelepipedic parts on the front ends thereof. The two undersides of these covering walls form contact surfaces 2 and 3 located in a common plane, as shown in FIG. 3, for placing the spacer on two adjacent bricks 19 and 20.

Below the two contact surfaces 2 and 3, nominal width stops 4 and 5 are formed by the sidewalls of the smaller parallelepipedic parts 1'' in two parallel planes perpendicular to the contact surfaces 2 and 3 and the distance between the same corresponds to the nominal width B of the vertical joints between the bricks 19, 20 of the facing brickwork. Nominal depth stops 6, 7 and 9 are provided in two further parallel planes, perpendicular both to the plane of contact surfaces 2, 3 and to the planes of the nominal width stops 4, 5 for adjacent bricks 19, 20 and the distance between said planes corresponds to the nominal depth T of the spacing between the facing brickwork and the inner brickwork. Said stops 6, 7 and 9 serve to determine the spacing between in each case two adjacent bricks 19, 20 of the facing brickwork on the one hand and in the inner brickwork to be faced on the other.

This nominal depth T can for example be 20 mm and the nominal width B of the joint between two adjacent bricks 19, 20 can for example be 10 mm.

A further preferred embodiment of the spacer is shown in FIG. 2. It is constructed in the manner of a box-like hollow body 11 with approximately equally dimensioned walls 12, 13, 14, 15 and 16. 12 is the covering wall of the box-like hollow body 11, 13 is a wall extending symmetrically downwards at an angle from the centre of the front edge of the covering wall and whose horizontal dimension corresponds to the nominal width B and is shorter than the front edge of covering wall 12, 14 and 15 are two walls which extend downwards at an angle from the lateral edges of covering wall 12 and whose horizontal dimensions correspond to the nominal depth T and extend to the rear end of covering wall 12, but is shorter than their lateral edges and 16 is a rear wall of the box-like hollow body 11, which can be useful for stiffening the sidewalls 14, 15 but can also be omitted.

It is also possible to provide other stiffening ribs between in each case two walls of the box-like hollow body 11 which form an angle between them, e.g. the T-shaped rib arrangement 17, 18 indicated by broken lines in FIG. 2 comprising a traverse wall 17 between walls 12, 14, 15 with the height of the front edges of the two latter walls and a wall 18 extending between the centre of wall 13 and the centre of transverse wall 17.

The spacer is preferably constructed as a shaped plastic body, so that it can be economically manufactured in large numbers and at low cost.

A spacer which, as illustrated in FIG. 3, is placed between in each case two adjacent bricks of the facing brickwork and between the latter and the already standing inner brickwork (not shown in the drawing) and is left there, facilitates the alignment of the bricks of the facing brickwork during their construction, so that working time is saved. Furthermore, this aid also facilitates bricklaying for unskilled personnel.

According to another embodiment of the spacer according to the invention, a projection is provided extending from the covering wall in the upwards direction and whose vertical dimension corresponds to the nominal height of the horizontal joints of the facing brickwork. In the case of the spacer 1 (11) shown in FIG. 3, such a projection is e.g. 21. Its vertical dimensions correspond to the nominal height T of the horizontal joints of the facing brickwork. It is immediately apparent that such an additional vertical projection on the spacers can constitute a valuable aid during the building of the facing brickwork, because it facilitates the adherence to the nominal height of the horizontal joints between the bricks.

FIGS. 4 and 5 show a spacer, which can be much more universally used, particularly when erecting a facing brickwork when it can be used on the front surface thereof and then at the end of the bricklaying work can be removed from the mortar joints at the front of the wall. T is the nominal depth of the distance between a facing brickwork to be erected and the already existing inner brickwork of for example 20 mm, B is the nominal width of the vertical joints and H is the nominal height of the horizontal joints of the facing brickwork, whereby B and H are for example 10 mm in each case.

The spacer according to FIGS. 4 and 5 has a covering plate extending to opposite sides from a vertical central wall 25 and whose one portion 26 extends to one side of the wall 25 and whose other portion 27 extends to the other side thereof. One portion 26 of the covering plate passes by its front end into the vertical wall 13 which gives the nominal width B and forms on its underside the horizontal contact surfaces 2, 3 which are in a common plane. On its lateral edges, wall portion 26 carries upwardly projecting walls 30 and 31, the height of which corresponds to the nominal height H. The other portion 27 of the covering plate extending to the other side of wall 25 has a length corresponding to the nominal depth T and forms with its top a contact surface.

On its lateral edges, portion 27 of the covering wall also has vertically downwardly projecting walls 14, 15, whose height corresponds to the nominal height H. Covering wall portion 27 also has an opening 32 constructed as an eyelet into which can engage a hook-shaped tool in order to remove the spacer from the brickwork after construction of the wall.

When erecting a facing brickwork, the spacer which can be produced as an inexpensive, but sufficiently stable shaped plastic part is used as follows:

At the rear of the brickwork, the spacer is placed by its contact surfaces 2 and 3 onto two corners of juxtaposed bricks so that the width of the wall portion 13 engaging between the bricks gives the nominal width B and the length of the portion 27 of the covering plate projecting rearwardly from the brickwork is in contact with the inner brickwork and consequently gives the nominal depth T. In the same way, such a spacer can be used on the front of the brickwork for giving the joint width by means of wall portion 13, whereby it also rests by means of contact surfaces 2, 3 on the corners of a brick. The nominal height of the horizontal joint for the alignment of the overlying brick is given by means of the wall portions 30, 31 of the two spacers positioned in this way. Before positioning the overlying brick, a spacer is placed in a reversed position on the centre of the lower brick at the front and optionally at the rear, so that the contact surface 27 and the wall 25 are in contact with the lower brick. Thus, the height of the horizontal joint between the lower and upper brick can be predetermined during the alignment thereof.

At the end of the bricklaying work, the spacers projecting at the front of the facing brickwork can be removed and optionally reused. The eyelet 32 or, with the reverse positioning of the spacer, the forwardly projecting wall portion 13 can be used for the engagement with a hook-shaped tool.

I claim:

1. Spacer for laying bricks of a facing brickwork to be placed in front of and at a predetermined distance from a previously laid inner brickwork, said spacer comprising a unitary body having a normal use position for placing the facing brickwork in front of an upstanding inner brickwork and in the normal use position said spacer comprising a first horizontal wall including a pair of contact surfaces located in a common horizontal plane with said contact surfaces facing downwardly, a pair of vertically extending width stops each extending perpendicularly downwardly from the common plane of said contact surfaces, said width stops being in spaced relation so that the overall spacing between the surfaces of said stops facing away from one another corresponds to the normal horizontal joint width between two adjacent bricks in the same course, wall means defining at least a pair of distance stops disposed in spaced parallel relation and extending perpendicularly to said contact surfaces and to said width stops, said first wall and said width stops extending perpendicularly from one side of a common vertically extending plane and said wall means extending perpendicularly in the opposite direction from said common vertically extending plane and the spacing between said distance stops in the horizontal direction corresponding to the spacing between the facing brickwork and the inner brickwork.

2. Spacer, as set forth in claim 1, wherein said spacer is in the form of a box-like hollow body comprising a plurality of second walls of approximately equal thickness, a pair of said second walls being disposed vertically extending and each forming a pair of said distance stops at the opposite vertically extending ends of said second walls, and said first wall located in a common plane with one of said second walls with said first wall projecting from one side of the common vertically extending plane and said second wall being located on the opposite side of said common vertically extending plane.

3. Spacer, as set forth in claim 2, wherein said first wall having a front edge disposed in parallel relation with and spaced horizontally from said common vertically extending plane, a third wall extending centrally downward from the front edge of said first wall and said third wall having a horizontal dimension corresponding to the dimension between the outwardly facing surfaces of said width stops, and said second walls forming distance stops extending vertically downwardly from a pair of opposite sides of said second wall located in the plane of said first wall.

4. Spacer, as set forth in claim 3, wherein a reinforcing wall extends perpendicularly to said first wall and to said third wall.

5. Spacer, as set forth in claim 3, wherein a T-shaped reinforcing wall includes a head portion and a leg portion, said head portion extending in said common vertically extending plane between a pair of said second walls and located along the junction between said first wall and said second wall located in the plane of said first wall, and said leg portion extending perpendicularly to said head portion and located below said first wall.

6. Spacer, as set forth in claim 1, wherein said spacer comprises a shaped plastic body.

7. Spacer, as set forth in claim 1, wherein a projection extends vertically upwardly from said front wall above said width stops and the vertical dimension of said projection above said first wall corresponding to the nominal height of the horizontal joints in the facing brickwork.

8. Spacer, as set forth in claim 1, wherein said spacer comprises a metal stamping.

9. Spacer, as set forth in claim 1, wherein a pair of fourth walls extend upwardly from said first wall with each said fourth wall extending from an opposite edge of said first wall extending outwardly perpendicularly relative to said common vertically extending plane, said fourth walls having a height substantially corresponding to the height of the horizontal joints of the facing brickwork and said wall means comprising second walls extending in the opposite direction from said vertically extending common plane relative to the direction of said first wall, one of said second walls extending in the common plane with said first wall and having a pair of said second walls extending downwardly from the opposite sides thereof with the height of said downwardly extending second walls being substantially equal to the height of the horizontal joint of the facing brickwork.

10. Spacer, as set forth in claim 9, wherein said second wall located in the same plane as said first wall having an opening therethrough constructed as an eyelet.

* * * * *